US005540193A

United States Patent [19]

Achten et al.

[11] Patent Number: 5,540,193

[45] Date of Patent: Jul. 30, 1996

[54] METHOD FOR THE COLD START OF A FREE-PISTON ENGINE; AND FREE-PISTON ENGINE ADAPTED FOR USE OF THIS METHOD

[75] Inventors: Peter A. J. Achten, Eindhoven; Theodorus G. Potma, Kaag, both of Netherlands

[73] Assignee: Innas Free Piston B.V., Breda, Netherlands

[21] Appl. No.: 244,236

[22] PCT Filed: Nov. 19, 1992

[86] PCT No.: PCT/NL92/00208

§ 371 Date: May 18, 1994

§ 102(e) Date: May 18, 1994

[87] PCT Pub. No.: WO93/10341

PCT Pub. Date: May 27, 1993

[30] Foreign Application Priority Data

Nov. 19, 1991 [NL] Netherlands ..... 9101930

[51] Int. Cl.[6] ..... F02B 71/02

[52] U.S. Cl. ..... 123/46 SC; 123/46 E

[58] Field of Search ..... 123/46 E, 46 SC, 123/279, 259, 661

[56] References Cited

U.S. PATENT DOCUMENTS

| | | | |
|---|---|---|---|
| 4,532,431 | 7/1985 | Iliev et al. | 123/46 E |
| 4,876,991 | 10/1989 | Galitello | 123/46 E |
| 4,924,956 | 5/1990 | Deng et al. | 123/46 E |
| 5,002,020 | 3/1991 | Kos | 123/46 E |
| 5,144,917 | 9/1992 | Hammett | 123/46 SC |
| 5,307,773 | 5/1994 | Suzuki | 123/661 |

*Primary Examiner*—Marguerite McMahon
*Attorney, Agent, or Firm*—Kinney & Lange

[57] ABSTRACT

The invention relates to a method for the cold start of a free-piston diesel engine, comprising a cylinder having a combustion room therein and an air inlet, fuel supply and combustion gas outlet connected thereto, and a piston movable within the cylinder and limiting one side of the combustion room. Energy is supplied to the piston to compress air supplied through the inlet by reducing the combustion room, whereafter fuel is injected to allow the fuel-air mixture to ignite by spontaneous combustion. So much compression energy is delivered to the piston that the combustion room is reduced to a volume of less than 3% of the combustion room volume when the outlet is closed. The corresponding free-piston engine has a dead volume of less than 3%.

8 Claims, 4 Drawing Sheets

Fig.3 TIME (SEC.)

METHOD FOR THE COLD START OF A FREE-PISTON ENGINE; AND FREE-PISTON ENGINE ADAPTED FOR USE OF THIS METHOD

BACKGROUND OF THE INVENTION

The invention relates to a method for the cold start of a free-piston engine that produces hydraulic or electric energy, adapted for a maximum stroke frequency of at least 10 Hz and comprising a stationary cylinder having a combustion room therein and an air inlet connected thereto, a fuel supply and combustion gas outlet and a piston which is freely movable within the cylinder and which limits the combustion room on one side, wherein energy is supplied to the piston to compress air supplied through the inlet by reducing the combustion room, whereafter fuel is injected into a depression in the piston or the stationary cylinder head to allow the fuel-air mixture to ignite by spontaneous combustion. Such method is known from EP-A-0 254 353.

It is well known that diesel engines are generally hard to start, particularly at low temperatures. This is a result of the fact that the ignition of the fuel-air mixture should take place by spontaneous combustion requiring a high temperature. In conventional diesel engines it is not possible to reach this temperature immediately at the first or second compression stroke. This is no problem with diesel engines having a crank shaft controlled piston, because the electric motor driving the crank shaft allows the piston to make a plurality of strokes in rapid succession causing the temperature in the combustion room to rise and shortly thereafter the circumstances are obtained in which ignition by spontaneous combustion can occur. Nonetheless, diesel engines are often equipped with special aids to facilitate the starting procedure. In diesel engines having a pre-combustion chamber there is often provided a spiral filament within the pre-combustion chamber in order to preheat the pre-combustion chamber. In diesel engines having direct injection there are sometimes provisions for injecting, at the start, ether into the combustion room, which is highly inflammable and consequently facilitates the ignition of the fuel-air mixture. Preheating installations for the entire cylinder head are also known.

In diesel engines having a free piston the starting problem is even worse than in diesel engines having a crank shaft piston because it is not possible to make a plurality of strokes in rapid succession. Then, due to the non-occurrence of an ignition within the combustion room, the piston will not make a sufficient expansion stroke in order to bring the piston to the bottom dead centre again in order to make a new compression stroke by means of the hydraulic or electric device. When no ignition occurs one should first complete a special procedure to bring the piston again to the bottom dead centre and during this period the heat produced within the combustion room by the preceding compression stroke is lost again for the greater part by heat removal. The residence time of the piston in the top dead centre is forcibly short in a free-piston engine so that the combustion conditions are unfavourable compared to a crank shaft engine.

SUMMARY OF THE INVENTION

The object of the present invention is to provide a method for the cold start of a free-piston diesel engine in which the problem as described is removed in an effective way.

For this purpose the method according to the invention is characterized in that such amount of energy is delivered to the piston that the volume of the compressed air in the combustion room is reduced to a volume of less than 3% of the combustion room volume when the outlet is closed, and that the compressed air absorbs all delivered energy before the piston can touch the stationary cylinder.

By following this method it is possible, also at low temperatures, to obtain a sufficiently high temperature within the combustion room to cause ignition of the fuel-air mixture. The polytropic exponent enabling the calculation of the temperature rise of the gas mixture during compression depends from the temperature of the walls of the combustion room and the gas composition and may vary from 1.20–1.25 in a cold engine to 1.35–1.38 in a hot engine showing a proper gas scavenging action. A result of the increase of this polytropic exponent during the heat up period of the diesel engine is that when the input of compression energy for making the compression stroke of the piston remains the same, the pressure and temperature within the combustion room increase. Due to the higher pressure within the combustion room, however, the piston is braked sooner and the compression ratio decreases. The temperature rise of the compressed mixture is consequently limited. This means that the energy supplied to the piston during the compression stroke may remain constant when the engine temperature rises, also because the polytropic exponent stabilizes at its maximum value. After the very high compression ratio according to the invention when the engine is started, it is more or less self-adjusting so that special measurements are hardly required when the engine warms up after the cold start.

FR-A-1.189.518 discloses a free-piston diesel engine pile driving hammer, in which the compression ratio is at least 30, preferably between 40 and 70 and most preferably 60. This high compression ratio is selected to increase the proportion of energy from the gas pressure and to decrease the proportion of energy from mechanical impact in the total driving energy.

In case leakage losses past the piston occur during compression, the so-called blow-by, which will most certainly occur when piston rings are used as sealing means, the compression ratio at the start should even be higher than indicated and preferably the combustion room is reduced to a volume of less than 2% of the combustion room volume when the outlet is closed.

The invention further includes a free-piston engine adapted for a maximum stroke frequency of at least 10 Hz and comprising a stationary cylinder having a combustion room of variable volume which is limited on one side by a first wall and on the opposite side by a second wall formed by the top of a piston which is displaceable within the cylinder and which has a sealing means around its circumference and a rod shaped extension that works together with a hydraulic or electric system and which converts hydraulic or electric energy into a variable amount of mechanical energy, an air inlet, a fuel supply and an injection system that creates a fuel-air mixture that ignites in the combustion room by spontaneous combustion and a combustion gas outlet connecting to the cylinder, and which is characterized according to the invention in that the volume between both walls of the combustion room and the sealing means in the extreme position of the piston for minimizing the combustion room is less than 3% of the volume to be compressed between both walls of the combustion room and the sealing means in the position of the piston in which the combustion gas outlet is just closed.

This small dead volume may be obtained by minimizing the swirl space left in one or both opposite walls for the atomized fuel and by placing the sealing means of the piston, such as the upper piston ring for example, as close to the piston top bottom as possible.

In case of expected leakage losses the dead volume may even be limited to a maximum of 2% in order to reach a sufficiently high pressure and temperature within the combustion room when the engine is started.

An additional or alternative way of facilitating the start of a free-piston diesel engine is artificially and temporarily making the piston heavier. Then, it has been proved that an increase of the mass of the piston facilitates the ignition of the fuel-air mixture because then the very short residence time in the top dead centre which is characteristic for a free-piston diesel engine is extended so that more time is available for combustion of the fuel-air mixture. Consequently, the invention proposes to provide the piston with a weight which can be coupled and uncoupled during operation and which may, for example, seat as a ring around a rod shaped extension of the piston and which may selectively be coupled to the piston or held to the cylinder block by means of a hydraulic, electromagnetic or some other coupling.

BRIEF DESCRIPTION OF THE DRAWINGS

The invention will now be described with reference to the drawing illustrating an embodiment of the invention by way of example.

DETAILED DESCRIPTION OF THE PREFERRED EMBODIMENTS

Figure 1:
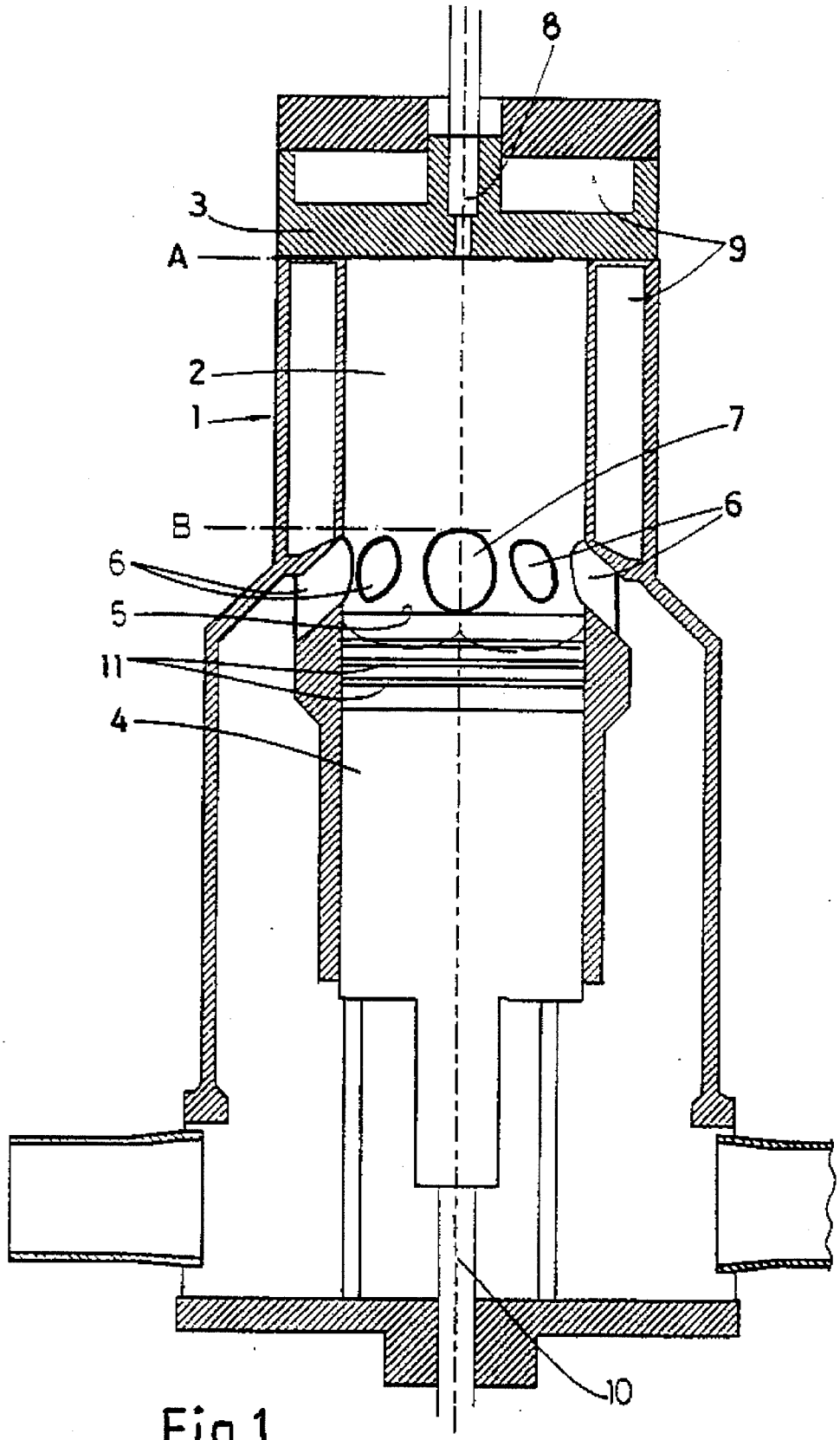
FIG. 1 is a longitudinal sectional view of a free-piston diesel engine adapted for use of the method according to the invention.

Referring to FIG. 1, the so-called free-piston engine operating according to the two-stroke cycle diesel principle comprises a cylinder I defining a combustion room 2. In this embodiment by way of example, the combustion room 2 is closed on one side by a stationary cylinder head 3 and on the opposite side by a piston 4 reciprocating within the cylinder 1. It should, however, be noted that the invention may also be used in a free-piston engine of which the combustion room is limited on both sides by a movable piston.

The piston 4 is movable between the so-called bottom dead centre, as shown in FIG. 1, and a top dead centre in which the top 5 of the piston 4 is lying near the cylinder head 3.

In the circumferential wall of the cylinder 1 there are formed inlet ports 6 for supplying combustion air to the combustion room 2 during the compression stroke of the piston 4 from the bottom dead centre to the upper dead centre, and also one or more outlet ports 7 for exhausting combustion gasses from the combustion room 2 at the end of the expansion stroke of the piston 4 from the top dead centre to the bottom dead centre.

An injector 8 is mounted in the cylinder head 3 in order to inject liquid fuel, such as diesel oil, at the end of the compression stroke of the piston 4. In the cylinder 1 and the cylinder head 3 are also rooms 9 for the circulation of a coolant.

The piston 4 is equipped with a rod shaped piston extension 10 cooperating in a conventional way with a hydraulic or electric device for converting mechanical energy rendered to the piston 2 during the combustion of the fuel-air mixture into hydraulic or electric energy and converting variable hydraulic or electric energy into mechanical energy of the piston 4 in order to make the compression stroke of the piston 4. Since this hydraulic or electric device is not a part of the invention, it is not described in further detail.

Figure 2:
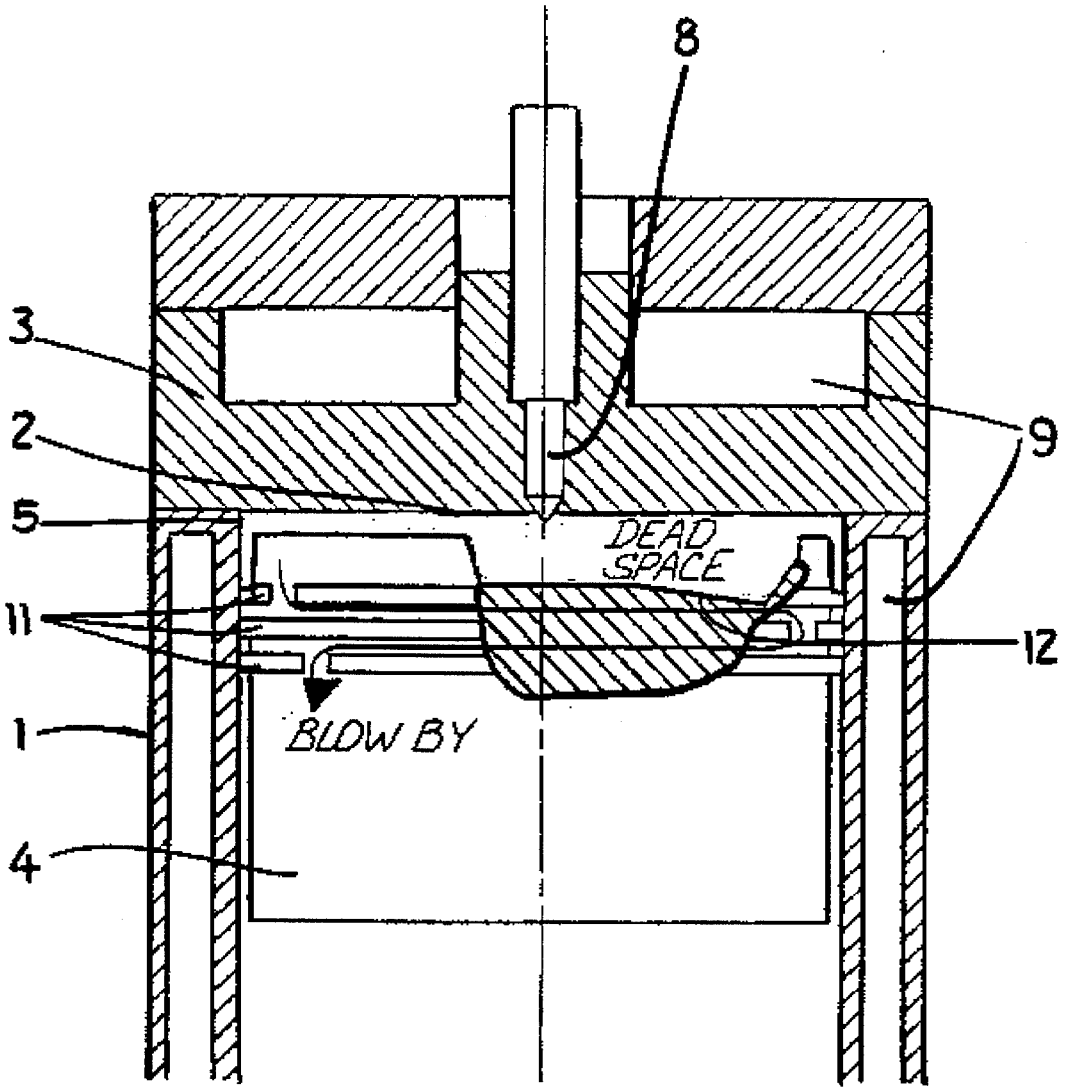
FIG. 2 shows on an enlarged scale a fraction of the section of FIG. 1 when the piston is near its top dead centre.

As shown in FIG. 1, but particularly in FIG. 2, the piston 4 has a plurality of piston rings 11 around its circumference serving as sealing means between the piston 4 and the circumferential wall of the cylinder 1. Furthermore, there is formed a depression 12 in the piston top 5 in which the combustion of the fuel-air mixture may take place. In principle this depression could also be formed completely or partly in the cylinder head 3.

According to the invention, the piston 4 and the cylinder head 3 are configured such that the dead volume between the piston top 5 of the piston 4 and the upper piston ring 11, or the cylinder head, respectively, when the piston 4 abuts the cylinder head 3 (position A in FIG. 1) is less than 3% of the volume between the piston 4 and the upper piston ring 11 and the cylinder head 3, respectively, in the position of the piston 4 in which the outlet port 7 is just closed (position B in FIG. 1). Preferably, this dead volume is even 2% or less, in order to compensate for the leakage losses from the combustion room past the openings between the free ends of the piston rings 11 (blow-by), and consequently still reach a sufficiently high pressure and temperature in the method according to the invention for starting the free-piston engine.

Figure 3:
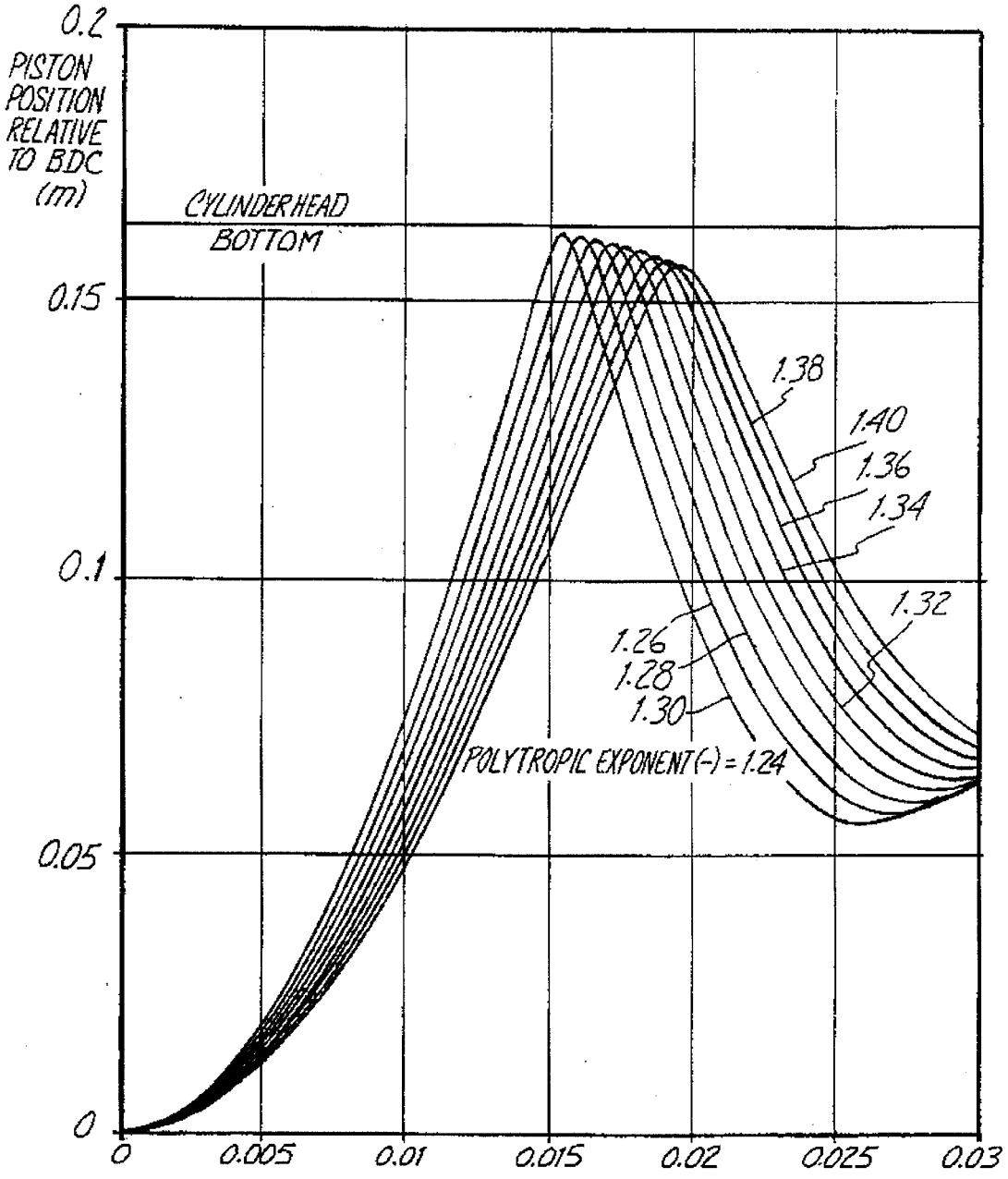
FIG. 3 is a diagram illustrating the piston movement as a function of the time in situations in which ignition of the fuel-air mixture just occurs, with different polytropic exponents.

In the diagram of FIG. 3 (for a piston of 3 kg and a maximum stroke frequency of 35 Hz) there is shown a displacement of the piston top 5 of the piston 4 in a compression stroke from the bottom dead centre where an ignition of the fuel-air mixture is only just possible, but wherein it is not shown how the piston moves after ignition of the fuel-air mixture, but without ignition. This also shows that in the expansion stroke without ignition of the fuel-air mixture the piston does not return to the bottom dead centre but remains at a distance therefrom. The upper horizontal line in the diagram indicates the position of the lower side of the cylinder head in relation to the bottom dead centre of the piston.

The various curves of the diagram illustrate the piston movement required for ignition of the fuel-air mixture with different polytropic exponents. This polytropic exponent can vary between 1.24 in a very cold engine and 1.40 in a hot engine showing a very good gas scavenging action. A comparison of the various curves shows that a polytropic exponent of 1.24 requires a longer piston stroke length to just cause an ignition of the fuel-air mixture than a higher polytropic exponent. The cold start of the diesel engine therefore necessitates a much higher compression ratio than a hot engine.

Figure 4:
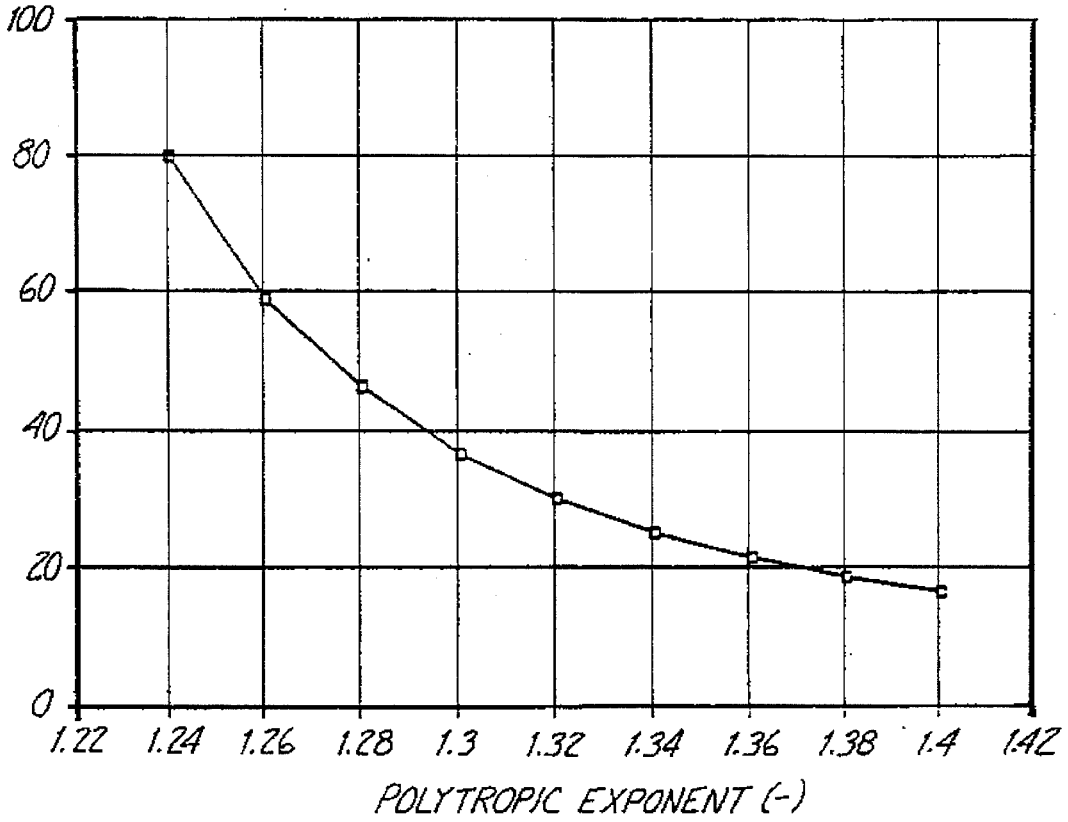
FIG. 4 is a diagram illustrating the required compression ratio as a function of the polytropic exponent, where ignition of the fuel-air mixture is only just possible.

This relationship between the compression ratio $\Sigma$ required for ignition and the polytropic exponent is illustrated in the diagram of FIG. 4, in which it is shown that the required compression ratio $\Sigma$ (ratio of the volume of the combustion room when the outlet port is closed and the volume of the combustion room in the top dead centre of the piston) decreases when the polytropic exponent increases.

In order to obtain the high compression ratio in a cold engine without the risk of the piston striking against the cylinder head in its compression stroke which might damage the engine and make it unserviceable, the dead volume above the piston should preferably be minimized because said risk diminishes when the dead volume or the dead space is reduced.

With respect to the curve in the diagram of FIG. 4 it is noted that this curve will be at a lower level when the weight of the piston is greater so that for starting it is favourable to have a heavy piston. Since a heavy piston has, however, an adverse effect on the power during normal operation, the invention proposes as an additional or alternative measure for starting a free-piston diesel engine to temporarily couple a weight to the piston 4, which may be uncoupled again after the engine has warmed up and without interruption of the piston cycle.

From the foregoing it will be clear that the invention provides a solution to the start problems occurring with light diesel engines having a free piston, that is engines having a low-weight piston operating at a maximum stroke frequency of at least 10 Hz (600 rpm). The lighter the piston is, the higher the maximum stroke frequency, the shorter the residence time of the piston in the top dead centre and the more difficult the ignition in a cold engine is.

The invention is not restricted to the embodiment shown in the drawing and described herein before by way of example, which may be varied in different manners within the scope of the invention. It is for instance possible to use the invention for a four-stroke engine having compression ignition instead of in the two-stroke engine described above. Furthermore, the invention may also be used in combination with well-known cold start aids, such as a spiral filament or heated surface in the compression room, heating of the inlet air and addition of highly inflammable substances such as ether.

What is claimed is:

1. A method for cold start of a free-piston engine adapted for a maximum stroke frequency of at least 10 Hz, comprising:

providing a free-piston engine having a stationary cylinder with a combustion room therein and an air inlet, a fuel supply, a combustion gas outlet, and a piston movable within the cylinder and which limits the combustion room on one side, wherein the piston is moved in the direction of the combustion room by a drive system to close the air inlet and the combustion gas outlet and to compress the gas which consists primarily of air, in the combustion room, whereby the pressure of the gas in the combustion room decelerates the compression movement of the piston and whereby fuel injected into the combustion room allows the fuel-gas mixture to ignite by spontaneous combustion;

starting the free-piston engine by delivering an amount of energy from the delivery system to the piston such that the volume of the compressed gas in the combustion room is reduced by the compression movement of the piston to a volume of less than 3% of the combustion room's gas volume at the moment all inlet and outlet openings are closed by the piston and such that the compression movement of the piston is stopped by the pressure of the gas in the combustion room.

2. The method according to claim 1, wherein the volume of the compressed gas in the combustion room is reduced by the compressive movement of the piston to a volume of less than 2% of the combustion room's gas volume at the moment inlet and outlet openings are closed by the piston.

3. A flee-piston engine adapted for a maximum stroke frequency of at least 10 Hz, the free-piston engine comprising:

a stationary cylinder having a first wall; and a piston movable within the cylinder, the piston including a sealing means around its circumference, an air inlet, a fuel supply, a combustion gas outlet connecting to the cylinder, and a top opposite to the first wall of the cylinder such that a combustion room is formed between the first wall of the cylinder and the top of the piston, wherein the piston reciprocates within the cylinder between a first position and a second position and wherein the dead volume between the walls of the combustion room is less than 3% of the volume to be compressed between both walls of the combustion room in the second position of the piston in which the combustion gas outlet is just closed.

4. The free-piston diesel engine according to claim 3, wherein said dead volume is less than 2% of the volume to be compressed.

5. Method for the cold start of a flee-piston engine adapted for a maximum stroke frequency of at least 10 Hz and comprising a stationary cylinder having a combustion room therein and an air inlet, a fuel supply and a combustion gas outlet connected thereto and a piston which is movable within the cylinder and which limits the combustion room on one side, wherein the piston is moved in the direction of the combustion room by a drive system to close the air inlet and the combustion gas outlet and to compress the gas which consists primarily of air, in the combustion room, whereby the pressure of the gas in the combustion room decelerates the compression movement of the piston and whereby fuel is injected into the combustion room to allow the compressed fuel-gas mixture to ignite by spontaneous combustion, characterized in that such amount of energy is supplied to the piston by the drive system that the volume of the compressed gas in the combustion room is reduced by the compression movement of the piston to a volume of less than 3% of the combustion room's gas volume at the moment all inlet and outlet openings are closed by the piston and that the compression movement of the piston is stopped by the pressure of the gas in the combustion room.

6. Method according to claim 5, wherein the volume of the compressed gas in the combustion room is reduced by the compression movement of the piston to a volume of less than 2% of the combustion room's gas volume at the moment all inlet and outlet openings are closed by the piston.

7. Free-piston engine adapted for a maximum stroke frequency of at least 10 Hz and comprising a stationary cylinder having a combustion room of variable volume which is limited on one side by a first wall and on an opposite side by a second wall formed by the combustion side of a piston which is displaceable within the cylinder and which has a sealing means around its circumference and a rod shaped extension that works together with a hydraulic or electric system and which converts hydraulic or electric energy into a variable amount of mechanical energy, an air inlet, a fuel supply, an injection system that creates a fuel-air mixture that ignites in the combustion room by spontaneous combustion, and a combustion gas outlet connecting to the cylinder, characterized in that the volume between both walls of the combustion room and the sealing means in the extreme position of the piston for minimizing the combustion room is less than 3% of the volume to be compressed between both walls of the combustion room and the sealing means in the position of the piston in which the combustion gas outlet is just closed.

8. Free-piston diesel engine according to claim 7, wherein said dead volume is less than 2% of the volume to be compressed.

* * * * *

UNITED STATES PATENT AND TRADEMARK OFFICE

CERTIFICATE OF CORRECTION

PATENT NO. : 5,540,193

DATED : JULY 30, 1996

INVENTOR(S) : PETER A.J. ACHTEN, THEODORUS G. POTMA

It is certified that error appears in the above-indentified patent and that said Letters Patent is hereby corrected as shown below:

On the Title Page [56] under "References Cited U.S. PATENT DOCUMENTS", insert --4,497,376 2/1985 Kurylko 173/1 Foreign Patent Documents 1189518 France 43184 The Netherlands--

Signed and Sealed this

Twelfth Day of November, 1996

*Attest:*

Bruce Lehman

BRUCE LEHMAN

*Attesting Officer*

*Commissioner of Patents and Trademarks*